US006079458A

United States Patent [19]

Sten

[11] Patent Number: 6,079,458

[45] Date of Patent: Jun. 27, 2000

[54] CARBON ACID DISPENSER

[75] Inventor: Ole Sten, Korsnäs, Finland

[73] Assignee: Oy Uni Import AB, Korsnas, Finland

[21] Appl. No.: 09/196,169

[22] Filed: Nov. 20, 1998

[30] Foreign Application Priority Data

Nov. 21, 1997 [FI] Finland ..... U970521

[51] Int. Cl.[7] ..... B67C 3/10

[52] U.S. Cl. ..... 141/14; 141/17; 141/349; 141/382; 261/DIG. 7; 99/323.1; 426/477

[58] Field of Search ..... 141/14, 17–19, 141/21, 348, 349, 382; 261/64.1, DIG. 7; 99/323.1, 323.2; 426/477

[56] References Cited

U.S. PATENT DOCUMENTS

| | | | |
|---|---|---|---|
| 4,867,209 | 9/1989 | Santoiemmo | 141/19 |
| 4,940,212 | 7/1990 | Burton | 261/64.1 |
| 4,947,739 | 8/1990 | Owen | 99/323.2 |
| 5,396,934 | 3/1995 | Moench | 99/323.1 |
| 5,531,254 | 7/1996 | Rosenbach | 141/17 |

*Primary Examiner*—J Casimer Jacyna
*Attorney, Agent, or Firm*—Burns, Doane, Swecker & Mathis, L.L.P.

[57] ABSTRACT

The present invention relates to a carbon dioxide dispenser and a cap (2) for introducing carbon dioxide to a bottle (1). The carbon dioxide dispenser of the invention comprises a pressurized carbon dioxide source, such as a pressure vessel (3), a pressure regulator (7), flow means (4, 6) for feeding carbon dioxide from the carbon dioxide source to a bottle, and said cap (2) provided with a valve for connecting said means to the bottle (1). The present invention provides a carbon dioxide dispenser which is easy to handle and has a reliable valve means which can be used by anyone without any risk of explosion during use. The invention also provides a carbon dioxide dispenser for effectively distributing the introduced carbon dioxide in the bottle. For this purpose the cap (2) comprises in its end facing the bottle (1) a distribution means (8) for atomizing the carbon dioxide so that, when flowing into the bottle, it is more effectively absorbed by the beverage in the bottle.

6 Claims, 2 Drawing Sheets

CARBON ACID DISPENSER

FIELD OF THE INVENTION

The present invention relates to a carbon dioxide dispenser comprising a pressurized carbon dioxide source, such as a pressure vessel, flow means for feeding carbon dioxide from the carbon dioxide source to a bottle and a cap provided with a valve for connecting said flow means to the bottle.

The invention further relates to a cap for use in said carbon dioxide dispenser, the cap comprising a neck, a mantle with a threaded coupling and an inlet and outlet conduit.

BACKGROUND OF THE INVENTION

It is a widely known problem that a carbonated beverage begins to lose its carbonation once the bottle or vessel containing it is opened. The fresh taste of the beverage deteriorates every time the cap is opened and some of the beverage is consumed. Consequently, the beverage needs to be re-carbonated.

A plurality of different processes and apparatuses have been designed for re-carbonating different beverages, such as soda and beer. The re-carbonation is usually carried out by introducing carbon dioxide into the bottle containing the beverage from a special pressure vessel or from small carbon dioxide vials. Compared with vials, pressure vessels hold a larger quantity of carbon dioxide. Such pressure vessels are coupled e.g. with a bayonet coupling to the bottle or vessel. Special coupling means and pressure regulators have been designed for this purpose.

However, existing methods have drawbacks and shortcomings. The most common problems are the excessive quantity of carbon dioxide flowing to the bottle or corresponding vessel and poor mixing of the introduced carbon dioxide with the beverage in the bottle or vessel.

It is true that small carbon dioxide vials are easy to transport and relatively easy to use, but so far no reliable closing means are available which would allow such a vial to be emptied gradually into a bottle or corresponding storage vessel. In known solutions, the entire contents of a vial consequently flow out and further to the bottle containing the beverage, when the vial seal is broken, irrespective of whether or not all the carbon dioxide is needed. This leads easily to an excessive pressure in the bottle, resulting in a risk of explosion. As with larger pressure vessels, the mixing of the introduced carbon dioxide with the beverage is also insufficient.

The present invention avoids the problems of current solutions. It is an object of the invention to provide the consumer with an easy-to-use carbon dioxide dispenser having a reliable valve means which can be used by anyone without any risk of explosion during use. It is a further object of the invention to provide a carbon dioxide dispenser for effectively distributing the introduced carbon dioxide so that it is more effectively absorbed by the beverage.

SUMMARY OF THE INVENTION

The above problems have been solved by the present invention which has the characteristics disclosed in the attached claims. The carbon dioxide dispenser of the invention is characterized in that the end of the cap bearing against the bottle comprises a distribution means for atomizing the carbon dioxide flowing to the bottle.

The cap of the invention is characterized in that the cap between the inlet conduit and the outlet conduit comprises a valve body and a therein arranged closing valve comprising a piston with a flange, the flange being arranged to interact with a sealing ring comprised by the cap to close the inlet conduit; and that the distribution means comprised by the cap is disposed in the outlet conduit.

A carbon dioxide dispenser of the invention can be easily positioned in a plastic bottle, but it is particularly well suitable for what is known as PET bottles. In addition to the pressure vessel, known per se and comprising a connecting hose, pressure regulator and coupling means, the apparatus comprises a cap. This cap is very small and comprises a distribution means for effectively atomizing the carbon dioxide. The atomized carbon dioxide is then absorbed very easily by the beverage in the bottle.

The design of the cap is simple and the cap can be used repeatedly in the same bottle or alternately in a plurality of bottles.

The apparatus can also be provided with different changeable gripping means, such as threads, allowing the apparatus of the invention to be used in a plurality of different types of bottles.

The apparatus of the present invention provides significant advantages over the known art. Accordingly, the carbon dioxide dispenser is preferably disposed in the bottle by screw threaded gripping means that are easy to handle, or by gripping means arranged in the bottle via a bayonet mounting or a friction coupling or some other rapid and easy manner known per se.

The carbon dioxide dispenser always provides the beverage with an optimal addition of carbon dioxide without subjecting the user to the risk of explosion.

The carbon dioxide dispenser of the invention is self-controlled, whereby the user does not have to control the pressure in the bottle, a suitable pressure level being maintained automatically.

The present invention has a simple design and needs no maintenance, making it inexpensive to purchase and operate.

BRIEF DESCRIPTION OF THE DRAWINGS

In the following the invention will be described in greater detail with reference to the drawing, which shows a preferred embodiment of the invention, and in which.

DETAILED DESCRIPTION OF THE PREFERRED EMBODIMENTS

Figure 1:
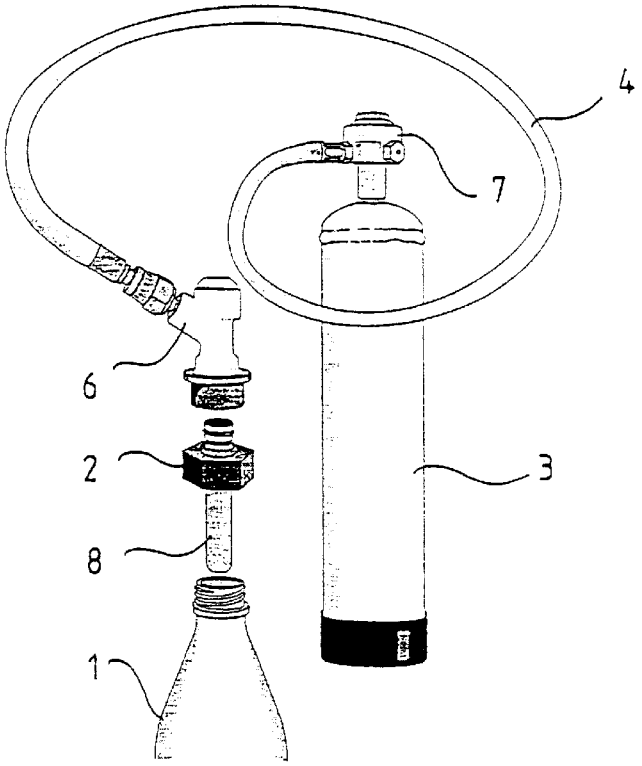
FIG. 1 shows a carbon dioxide dispenser with a cap of the invention.

FIG. 1 shows a bottle 1, preferably a PET bottle, in which a cap 2 is positioned. Carbon dioxide is fed from a carbon dioxide source 3, e.g. a pressure vessel, via different flow means to the bottle. Such means include a hose 4, whose first end is disposed in the pressure vessel via a pressure regulator 7 to prevent excessive pressure from being created in the bottle, and whose second end comprises a connecting means 6. However, the pressure regulator can also be disposed in the connecting means or some other suitable location in the flow means.

Accordingly, in a carbon dioxide dispenser of the invention, the pressure of the carbon dioxide in the flow means is automatically regulated by the pressure regulator 7 of the carbon dioxide dispenser. Consequently, when the connecting means is connected to the cap 2, carbon dioxide flows via the hose 4 and through the connecting means 6 to the bottle 1, and is mixed with the beverage therein. To enhance the absorption of carbon dioxide in the beverage, the carbon dioxide is atomized by a distribution means 8 disposed at the lower cap end bearing against the bottle. Such a distribution means preferably comprises what is known as a diffuser ("air stone"). The distribution means thus comprises a porous means which carbon dioxide penetrates to the bottle to be atomized. The means can be made from both metal, ceramics, wood or sandstone.

Figure 2:
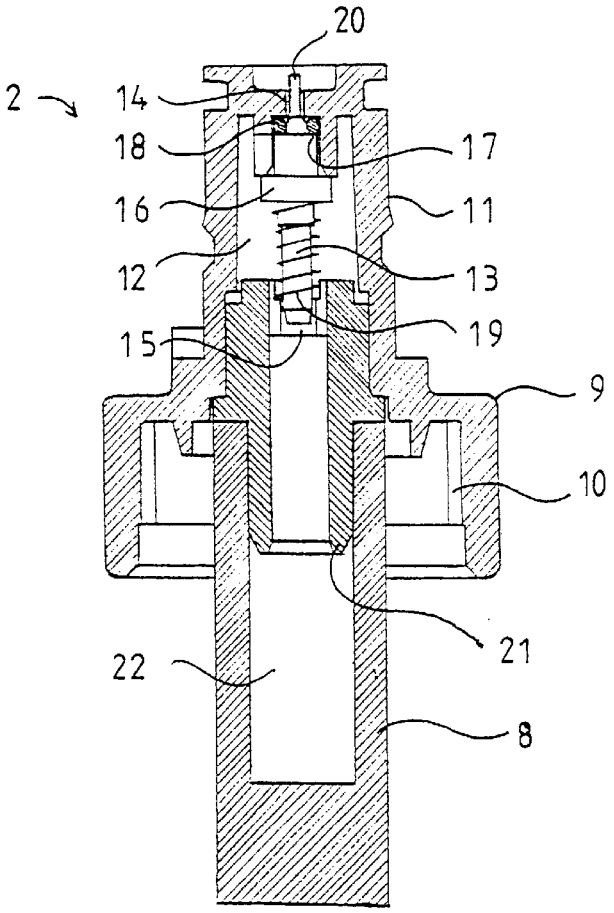
FIG. 2 is a cross-section of a cap according to FIG. 1.

With the cap 2 in an upright position according to FIG. 2, one can see that the cap comprises a mantle 9 with a normal threaded coupling 10 to couple the cap to the bottle. The cap further comprises a neck 11 arranged to interact with a bayonet mounting, known per se, to connect the cap to the connecting means 6.

The neck 11 comprises a valve body 12 and a therein arranged closing valve 13 which prevents carbon dioxide from flowing out of the bottle. The valve body is coupled both to the flow means by an inlet conduit 14, through which carbon dioxide flows from the connecting means 6 to the cap, and to the bottle 1 by an outlet conduit 15 through which carbon dioxide flows further from the valve body towards the bottle.

In an embodiment according to FIG. 2, the end of the closing valve 13 facing the connecting means 6 comprises a piston 16 with a flange 17. The piston is movably arranged in the valve body 12, and is movable in a direction substantially parallel to the longitudinal axis of the valve body. The flange comprised by the piston is arranged to interact with a sealing ring 18 in the immediate vicinity of the inlet conduit 14 to substantially close the inlet conduit. For this purpose the closing valve comprises a spring means 19 arranged to press the flange of the piston against the sealing ring with constant pressure. In this way the piston normally closes the inlet conduit 14, preventing gas or fluid from flowing through the cap in any direction.

When the intention is to supply a flow of carbon dioxide, the connecting means 6 is placed in the cap neck 11, and the bottle 1 is then turned in a position where the beverage in the bottle surrounds the distribution means 8 of the cap 2. A projection (not shown) in the connecting means forces the piston 16 to withdraw by subjecting to pressure a pin 20 disposed at the end of the piston facing the connection means. As a result, the flange 17 is detached from the sealing ring 18, the inlet conduit 14 is opened and carbon dioxide can freely flow to the valve body 12. The carbon dioxide flows past the piston towards the outlet conduit 15 disposed in the cap at the lower end of the valve body. The outlet conduit is preferably composed of a casing 21 which is joined to the cap by e.g. a press fit.

The carbon dioxide consequently flows through the outlet conduit 15 out of the cap to meet the distribution means 8 which is preferably disposed tightly to the casing 21. The distribution means can be arranged in the casing as shown in FIG. 2, the distribution means consequently comprising a recess 22 in which the casing is disposed. Thus the distribution means surrounds the casing and is preferably mechanically fastened to the mantle of the casing by e.g. a press fit.

Figure 3:
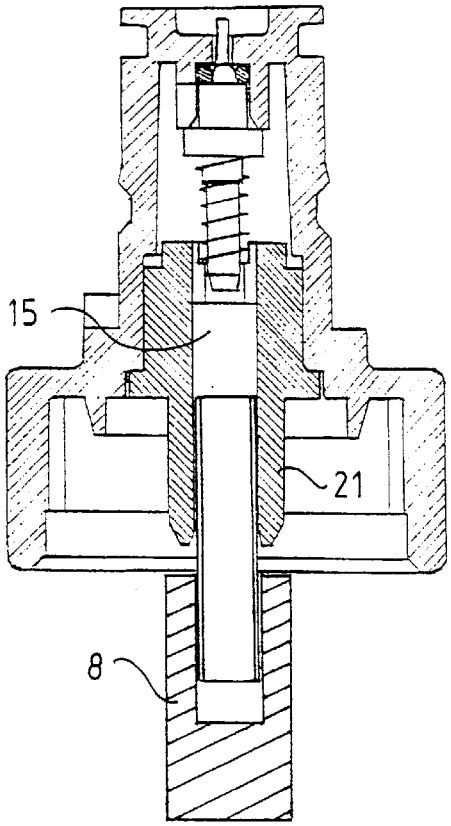
FIG. 3 is a cross-section of a second embodiment of a cap of the present invention.
Figure 4:
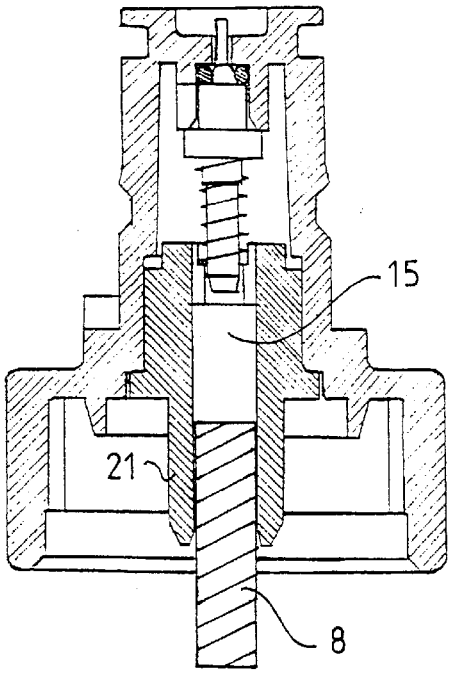
FIG. 4 is a cross-section of a third embodiment of a cap of the present invention.

As shown in FIG. 3, the distribution means 8 can also be disposed in the casing 21 by a nozzle which is joined to the inside of the casing in a manner known per se, e.g. by a glue joint or another suitable mechanical joint. Finally, the distribution means can be elongated so that it can be introduced into and fastened to the conduit of the casing, e.g. by a glue joint or another suitable mechanical joint, as shown in FIG. 4.

Finally the carbon dioxide is discharged through the walls of the distribution means 8, atomized and easily absorbed by the beverage in the bottle 1.

The carbon dioxide dispenser of the invention can be easily connected to any bottle 1. The cap 2 of the carbon dioxide dispenser can be easily cleaned e.g. by disinfecting it in boiling water.

In other words, when a beverage, such as soda or beer, has been bottled, the bottle 1 is closed by the cap 2 of the invention. When the beverage is to be re-carbonated, the connecting means 6 of the pressure vessel 3 is positioned in the cap, and carbon dioxide immediately starts to flow from the pressure vessel via the hose 4 to the cap 2 and further via the inlet conduit 14, valve body 12, outlet conduit 15 and distribution means 8 to the bottle. The bottle is then turned to make the beverage flow towards the cap to surround the distribution means, the beverage being carbonated by the atomized carbon dioxide flowing through the distribution means.

When the carbon dioxide flows into the bottle 1, the pressure rises both in the bottle and in the carbon dioxide dispenser. This pressure acts on the pressure regulator 7 and when the pressure in the bottle reaches a given threshold value, the flow of carbon dioxide from the carbon dioxide source to the bottle is automatically stopped by the regulator. This threshold value is preferably set upon manufacture of the carbon dioxide dispenser and cannot be changed by the user.

The specification and the related figures are only intended to illustrate the present invention. It is obvious that the invention is not restricted to the embodiment described above or in the attached claims, but many variations or alternative embodiments may be implemented within the scope of the invention as defined in the appended claims.

What is claimed is:

1. A cap adapted to be connected to a bottle to dispense carbon dioxide from a pressurized carbon dioxide source through a flow means into the bottle, said cap comprising:

a neck for receiving the flow means;

an inlet conduit and an outlet conduit through which flow the carbon dioxide from the pressurized carbon dioxide source when the cap is connected to the bottle;

a sealing ring disposed adjacent said inlet conduit;

a valve body disposed in the neck between the inlet conduit and the outlet conduit, said valve body having a closing valve containing a piston and a flange, said flange being arranged to interact with said sealing ring to substantially close said inlet conduit;

distribution means disposed at an end of said cap that bears against the bottle when said cap is connected to the bottle, said distribution means having a casing and a diffuser that atomizes carbon dioxide into the bottle, said casing being mechanically attached to the cap and said diffuser being connected to an outlet end of the casing.

2. A cap as claimed in claim 1, wherein at least a portion of said diffuser is disposed within said outlet end of said casing.

3. A cap as claimed in claim 1, wherein said diffuser comprises a recess, and wherein said outlet end of said casing is disposed within said recess of said diffuser.

4. A cap as claimed in claim 3, wherein said distribution means further comprises a nozzle, said nozzle connecting said outlet end of said casing to said recess of said diffuser.

5. A cap as claimed in claim 1, wherein said diffuser comprises an airstone.

6. A cap as claimed in claim 1, including a mantle surrounding a threaded coupling for connecting said cap to the bottle.

* * * * *